US011376758B2

(12) United States Patent
Thomas

(10) Patent No.: US 11,376,758 B2
(45) Date of Patent: Jul. 5, 2022

(54) TREATMENT OF WOODEN MATERIALS

(71) Applicant: Danish Wood Technology A/S, Copenhagen K (DK)

(72) Inventor: Kell Thomas, Søborg (DK)

( * ) Notice: Subject to any disclaimer, the term of this patent is extended or adjusted under 35 U.S.C. 154(b) by 0 days.

(21) Appl. No.: 16/995,954

(22) Filed: Aug. 18, 2020

(65) Prior Publication Data

US 2020/0376707 A1 Dec. 3, 2020

Related U.S. Application Data

(63) Continuation of application No. PCT/DK2019/000117, filed on Mar. 27, 2019.

(51) Int. Cl.
*B27K 3/02* (2006.01)
*B27K 3/08* (2006.01)

(52) U.S. Cl.
CPC ..... *B27K 3/0278* (2013.01); *B27K 3/08* (2013.01)

(58) Field of Classification Search
CPC ..... B27K 3/0278; B27K 3/08
See application file for complete search history.

(56) References Cited

U.S. PATENT DOCUMENTS

| | | | |
|---|---|---|---|
| 3,986,268 | A | 10/1976 | Koppelman |
| 2007/0128422 | A1 | 6/2007 | Nasheri et al. |

FOREIGN PATENT DOCUMENTS

| | | | |
|---|---|---|---|
| DE | 10354504 | | 6/2005 |
| EP | 0612595 | A1 | 12/1996 |
| GB | 905061 | A | 9/1962 |
| JP | H04189503 | | 7/1992 |
| KR | 20160124728 | A | 10/2016 |

OTHER PUBLICATIONS

Lebow, Stan T. 2010. Wood preservation. Wood handbook: wood as an engineering material: chapter 15. Centennial ed. General technical report FPL; GTR-190. Madison, WI: U.S. Dept. of Agriculture, Forest Service, Forest Products Laboratory, 2010: p. 15.1-15.28 (Year: 2010).*

Bucur, Acoustics of Wood, Second Edition, 2006, p. 1-394 (Year: 2006).*

Lebow, Stan T.: "Wood Preservation", Wood Handbook, Wood as an Engineering Material, Jun. 21, 2010 (Jun. 21, 2021), pp. 15-1, XP055349793, Madison, WI; Retrieved from the Internet: URL:https://www.fpl.fs.fed.us/documnts/fplgtr/fplgtr190/chapter 15.pdf [retrieved on Feb. 27, 2017] p. 18.

* cited by examiner

*Primary Examiner* — Tabatha L Penny
(74) *Attorney, Agent, or Firm* — Lambert Shortell & Connaughton; David J. Connaughton, Jr.; Justin P. Tinger

(57) ABSTRACT

The present invention relates to improved methods of treating wooden materials. By the method of the invention, the wooden material is subjected to vacuum, overpressure and increased temperature, and subjected to ultrasound. Ultrasound is applied while the wooden material is covered by a liquid at a suitable overpressure and at a suitable temperature for a suitable period of time.

12 Claims, 5 Drawing Sheets

TREATMENT OF WOODEN MATERIALS

FIELD OF THE INVENTION

The present invention relates to a method for the treatment of wooden materials. The present invention further relates to wooden materials obtainable by the method of the invention. The use of the method for preparing treated wooden materials is also contemplated. The wooden materials obtained by the method of the present invention have a broad range of uses.

BACKGROUND OF THE INVENTION

Wood is a widely used material for numerous applications, such as floors, building structures/houses, fences, lampposts, and furniture to mention a few. Various wood treatment techniques have been developed in order to improve the properties of wood with respect to e.g. resistance against fungi, durability, cracking and colour, wood eating bugs and rot.

Such wood treatment techniques include pre-drying, e.g. by heating, after which the wood is impregnated with an impregnating liquid, whereby the impregnating liquid is sucked into the wood by under-pressurising the chamber in which the wood is placed (so-called "vacuum impregnation"). After this process, pressure is applied either by hydraulic pressure generated by a pressure pump pumping additional liquid into the chamber, or by establishing an air pressure above the liquid level. The wood may subsequently be subjected to additional drying steps by applying vacuum.

Other treatment techniques may also be applied. E.g. EP 0 612 595 A1 relates to a method for upgrading low-quality wood to high-quality wood comprising the steps of (a) softening the wood by electrical heating in the presence of an aqueous medium, (b) drying the softened wood e.g. by dielectric heating, (c) curing the dried wood, and (d) cooling the wood. By this method, the ohmic or dielectric heating is applied both during the softening step and the drying step.

U.S. Pat. No. 3,986,268 A discloses a process and apparatus for accelerated drying of green lumber which employs high voltage dielectric heating at sub-atmospheric pressure to effect a rapid removal of moisture from the wood without splitting, cracking, case hardening, honeycombing or similar damage to the wood structure. The process combines the dielectric and vacuum drying. The use of sub-atmospheric pressures in the drying process also permits injection of suitable chemicals for fireproofing or other specialized treatments of the wood allowing the combination of such treatments with the drying of the wood in a single process.

From KR 20160124728 A, a method of treating wood is known. The method comprises the steps of placing wood in a vacuum chamber and evacuating air, followed by filling a flame retardant into the vacuum chamber, and thereafter applying pressure, followed by recovering the flame retardant by evacuation, dewatering the chamber, and subsequently drying the wood at a temperature of from 65° C. to 80° C. for 2 to 4 days. During the filling of the flame retardant, the flame retardant and the wood may be vibrated by ultrasonic waves. The evacuation of air, the filling of flame retardant, the pressurisation and the ultrasonic wave treatment take place at ambient temperature.

From PH 04189503 A, a method for treating wood is known. The method comprises the steps of placing the wood in a sealed container and decompressing the container, followed by injecting a liquid and applying ultrasonic waves. After exerting ultrasonic waves, the interior of the sealed container is pressurised. After approximately 30 minutes, the container is returned to atmospheric pressure.

Even though several techniques have been explored, there are still some drawbacks by the conventionally used techniques. E.g. the wood may not be fully impregnated since it has proven difficult to make the impregnating liquid reach the deeper interior of the wood logs, thus, rendering the wood susceptible for fungal attacks. Furthermore, wood that is not fully impregnated may be unsuitable for several applications involving further processing of the wood.

SUMMARY OF THE INVENTION

The present invention relates to the application of ultrasound in the treatment of a wooden material. Ultrasound is applied while the wooden material is covered with a liquid. The ultrasound is applied at a suitable pressure and at a suitable temperature for a suitable period of time.

In particular, the method for the treatment of a wooden material comprises (a) supplying a liquid to the wooden material, and (b) subjecting the wooden material to ultrasound at a suitable pressure and at a temperature between 70° C. and 220° C. for a suitable period of time.

Wooden material treated with ultrasound has a more natural structure compared with wooden material treated by the conventional methods involving heat treatment by calorimetric, ohmic or dielectric heat treatment.

By the conventional methods, structural changes, e.g. lignin degradation, are induced in the wooden material, whereby various impregnation components are absorbed by the wooden material due to the softening of the wooden material. By the present invention, the structure of the wooden material is better preserved, thereby offering advantages in comparison with the prior art wooden material.

More particularly, the present invention relates to a method for the treatment of a wooden material comprising the steps of a) subjecting the wooden material to a vacuum, b) supplying a liquid to the wooden material, while maintaining the vacuum, c) subjecting the wooden material to an overpressure at a temperature of between 70° C. and 220° C. at which the liquid does not reach its boiling point, d) subjecting the wooden material to ultrasound, while maintaining the overpressure, at a temperature between 70° C. and 220° C.

The present invention further relates to wooden material obtained by the method as described herein.

Also encompassed by the present invention is various uses of the wooden material obtained by the methods as described herein. Such uses include i.a. floors indoor and outdoor, buildings and fences, lampposts, and sculptures and decorations.

BRIEF DESCRIPTION OF THE DRAWINGS

The invention is illustrated by the accompanying drawing. The drawing is not intended to be limiting in any way.

DETAILED DESCRIPTION OF THE INVENTION

Figure 1:
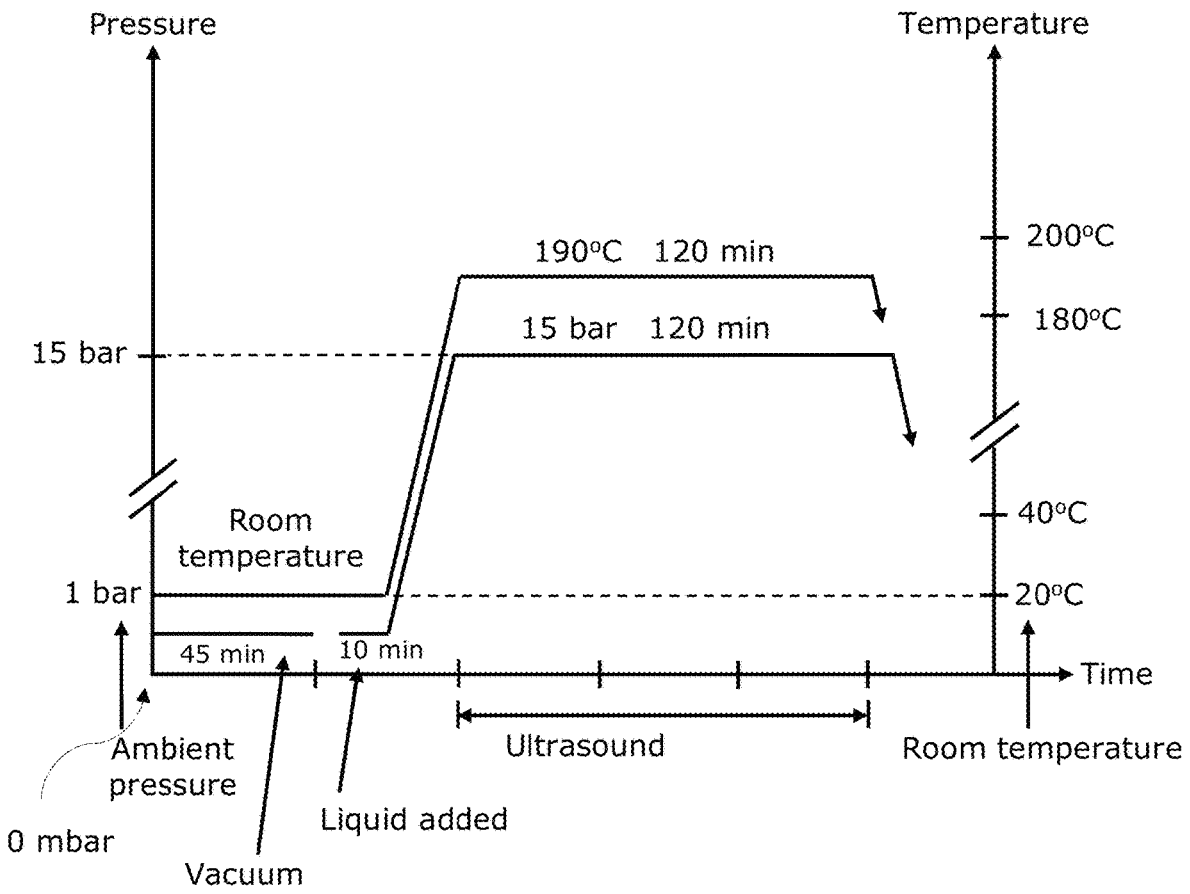
FIG. 1 shows a schematic view of the method of the invention.

The various aspects and embodiments of the present invention are described in more detail in the following.

According to the present invention, the method relates to the treatment of a wooden material comprising a) supplying a liquid to the wooden material, b) subjecting the wooden material to an overpressure and a temperature between 70° C. and 220° C., c) subjecting the wooden material to ultrasound at a temperature between 70° C. and 220° C. for a suitable period of time.

Liquid is supplied to the wooden material, followed by increasing the pressure so as to reach an overpressure. The temperature is between 70° C. and 220° C. in both steps. The wooden material is subjected to ultrasound while maintaining an overpressure and temperature between 70° C. and 220° C.

The combination of heating and ultrasound provides an improved impregnation as well as a controllable colouration of the wooden material. In particular, the impregnation depth can be controlled, and, thus, if desired, the wooden material can be fully impregnated leaving no parts of the wooden material untreated. Furthermore, the method enables at least a reduction of the use of environmental harmful impregnating agents.

In the present method, the liquid is supplied in such a way that the wooden material becomes fully covered by liquid.

Suitable pressures, temperatures and periods of time are described in further detail below.

Within the present context, the term "wooden material" includes material derived from trees of different genera. Non-limiting examples of tree genera include pine, cedar, cypress, fir, larch, spruce, oak, birch, beech, aspen, alder, elm, linden, *eucalyptus*, ash, mahogany, cherry, poplar, chestnut, marble, and redwood. The wooden material may suitably be selected from heartwood and sapwood.

Within the present context, ultrasound is defined as having frequencies from 1 kHz to 1 MHz. In general, within the purpose of this invention, the ultrasound frequency will be such that the ultrasound may be suitable for the purpose of the invention, thereby enabling treatment of the wooden material so as to enhance the properties of the wooden material. E.g., the frequency may be from 1 kHz to 120 kHz. It is to be understood that the frequency may in particular be 10 kHz, 20 kHz, 30 kHz, 40 kHz, 50 kHz, 60 kHz, 70 kHz, 80 kHz, 90 kHz, 100 kHz, or 110 kHz, as well as any non-integer value therebetween. Furthermore, different frequencies may be used during the application of the ultrasound. The frequency may depend on and may be adjusted according to the type of wooden material (e.g. heartwood or sapwood) and its content of water, oily components, form and thickness of the wooden material as well as the period of time of applying ultrasound, and on the temperature at which the ultrasound is applied. The intensity of the ultrasound can be varied depending of the number of ultrasound sources. In general, the effect of the ultrasound should be chosen to be from 1 to 20 Watt per litre liquid. The ultrasound is able to "knock" on the wooden material without breaking or destroying the structure of the wooden material. Ultrasound may be applied for a suitable period of time, e.g. from 1 minute to 15 hours. The suitable period of time may e.g. be 1 minute, 5 minutes, 15 minutes, 30 minutes, 45 minutes, 1 hour, 2 hours, 3, hours, 4 hours, 5 hours, 6 hours, 7 hours, 8 hours, 9 hours, 10 hours, 11 hours, 12 hours, 13 hours, 14 hours or 15 hours as well as any integer or non-integer therebetween. In one embodiment, the ultrasound is applied for 1 minute to 15 hours, such as from 5 minutes to 12 hours, or for 2 hours.

The ultrasound is provided through ultrasound sources placed at suitable positions relative to the wooden material. One or more ultrasound sources may be used. The number of ultrasound sources may depend e.g. on the amount and form of the wooden material to be treated.

More particularly, the present invention relates to a method for the treatment of a wooden material comprising the steps of a) subjecting the wooden material to a vacuum, b) supplying a liquid to the wooden material, while maintaining the vacuum, c) subjecting the wooden material to an overpressure at a temperature between 70° C. and 220° C. at which the liquid does not reach its boiling point, d) subjecting the wooden material to ultrasound, while maintaining the overpressure, at a temperature between 70° C. and 220° C.

By subjecting the wooden material to a vacuum, the withdrawal of air and moisture from the wooden material is facilitated. The temperature during this step may be chosen so as to be suitable having regard to the vacuum applied and further the amount, the condition, and/or the type of the wooden material. For this, the wooden material is placed in an airtight tank equipped with a vacuum pump for providing a vacuum. The airtight tank may further be equipped with valves for controlling the pressure in the airtight tank.

Liquid is supplied to the wooden material such that the wooden material becomes covered by the liquid. This is suitably performed by suction of the liquid into the airtight tank containing the wooden material from another tank containing the liquid through the established vacuum. The liquid is supplied to the wooden material at a suitable rate, while vacuum is maintained. The temperature of the liquid is chosen so as to be suitable having regard to the vacuum in the airtight tank and further the amount, the condition, and/or the type of the wooden material. In one embodiment of the present invention, the temperature of the liquid supplied is the same or nearly the temperature of the wooden material during the vacuum step. The liquid may suitably be supplied to the airtight tank containing the wooden material from another tank interconnected to the airtight tank by a valve. Due to the vacuum in the airtight tank, the liquid is drawn into the airtight tank from the other tank. The liquid is drawn into the airtight tank until the airtight tank is filled with liquid, and the wooden material is covered by the liquid. Furthermore, both the airtight tank and the other tank may be provided with heating means (heating aggregates)

or/and cooling means (cooling aggregates) for heating or cooling the liquid prior to or subsequently to supplying the liquid to the airtight tank.

Following the addition of the liquid, the vacuum pump of the airtight tank is turned off, and a pressure pump connected to the airtight tank is set to a suitable overpressure and started. Thereby, the wooden material is subjected to an overpressure. The overpressure facilitates the drawing of the liquid into the wooden material. By the overpressure, the boiling point of the liquid is also increased compared to the boiling point at atmospheric pressure. Thereby, the temperature of the wooden material and the liquid can be increased far beyond the possible temperature at atmospheric pressure without causing the boiling of the liquid, thereby facilitating impregnation of the wooden material, i.e. the liquid is drawn into the wooden material. The temperature and the overpressure are chosen so as to be suitable having regard to the amount, the condition, and/or the type of the wooden material as well as the liquid and optional components present in the liquid. The liquid may suitably be circulated/brought in contact with heating means (a heating aggregate) during the heating to ensure the temperature is kept at the desired temperature at all times. Thus, the liquid may continuously be heated to the desired temperature during the impregnation process.

The wooden material is subjected to ultrasound while maintaining the increased temperature and the overpressure. The wooden material is subjected to ultrasound for a suitable period of time. The overpressure, the temperature and the ultrasound period are chosen so as to be suitable having regard to the amount, the condition, and/or the type of the wooden material as well as the liquid and optional components present in the liquid, and further in view of the frequency of the ultrasound applied. The ultrasound is typically applied by means of a ultrasound generator or multiple ultrasound generators located in the airtight tank. The combination of overpressure and ultrasound facilitates the uptake of the liquid by the wooden material. In fact, the uptake of liquid may be twice the uptake using traditional pressure impregnation of wooden materials. Furthermore, the liquid penetrates deeper into the wooden material, thereby ensuring an improved impregnation depth. Thereby, the durability of the wooden material is increased markedly. As the impregnation of the wooden material is improved, the method of the invention further makes the use of more environmentally safe impregnation agents (the liquid or contained in the liquid) possible.

After completion of the ultrasound treatment, it may be preferred to firstly shut off the ultrasound source/sources, and thereafter to lower the temperature (either by natural cooling by turning off the heating, or by forced cooling), before equalising the overpressure to atmospheric pressure. If the overpressure is equalised before the temperature is sufficient low, this may cause the liquid to boil due to the temperature of the liquid. Atmospheric pressure may suitably be obtained through a valve or valves in the airtight tank.

As mentioned above, the wooden material is usually placed in an airtight tank suitable for applying both vacuum and overpressure. The airtight tank may further be interconnected to another tank for heating and suppling the liquid. The airtight tank and/or the other tank may further equipped with heating and/or cooling means (aggregates) for adjusting the temperature according to the desired conditions. The airtight tank as well as the other tank may have any form and size suitable for performing the method. Suited tanks are generally known in the art.

The wooden material may be stacked or otherwise placed in the airtight tank, optionally with means for spacing the pieces or logs of wooden material.

Within the present context, "liquid" is intended to be such suitable for covering the wooden material and further for applying the ultrasound. The liquid used in the method of the invention may be e.g. water, oil, and mixtures of water and another solvent, and may in some applications also suitably include wood treatment compounds like impregnating agents such as alum, boric acid solution, copper, oils such as linseed oil, wood tar and the like, fire retardants, biocides, fungicides, and/or pigments and colorants as well as combinations thereof. It is to be understood that one or more of the wood treatment compounds may be present in the liquid in an amount suitable for the intended effect and application but may depend on the type of wooden material and its air and moisture content. Wood treatment compounds as well as amount to be used are generally well-known in the art. In particular, the flame retardant may be a gaseous fire suppression substance suitable for extinguishing fire such as argon or halon.

The liquid may suitably be present in an amount sufficient to ensure a suitable uptake by the wooden material. The amount of liquid is generally dependent on the amount (size, weight, shape) of wooden material, the air and moisture content of the wooden material, the type of wooden material (e.g. beech, birch, pine, spruce, oak, mahogany as well as heartwood, bark, etc. as mentioned above) as well as the treatment conditions, e.g. pressure and the temperature applied. The amount of the liquid may further be adapted to the desired impregnation depth.

In one embodiment, the method according to the present invention comprises applying ultrasound of a frequency of from 1 kHz to 1 MHz, such as e.g. from 1 kHz to 120 kHz. In another embodiment, the frequency is from 20 kHz to 40 kHz. In a certain embodiment, the frequency is 30 kHz. Other suitable frequencies are defined above.

In another embodiment, the method according to the present invention comprises applying ultrasound for from 1 minute to 15 hours. It is to be understood that the time for which the ultrasound is applied may depend on other parameters such as e.g. the type, shape, size, weight, air and moisture content of wooden material to be treated as well as the liquid and the frequency of the ultrasound applied. It is further to be understood that the frequency of the ultrasound may be varied during the time of applying the ultrasound. It is also to be understood that the ultrasound may be applied in intervals, i.e. periods with and without application of ultrasound. In one embodiment, ultrasound is applied for 1 hour to 3 hours. In another embodiment, ultrasound is applied for 2 hours.

Initially, the wooden material is subjected to a vacuum. By "vacuum" is meant a pressure below the atmospheric pressure. Accordingly, the vacuum may be as low as 0 mbar.

Representative examples of vacuum include, but are not limited to, 1%, 5%, 10%, 20%, 30%, 40%, 50%, 60%, 70%, 80%, 90% and 100% of atmospheric pressure as well as any integer or non-integer values therebetween. It is to be understood that vacuum may also be specified in the unit "mbar". As a general rule, 1000 mbar is considered to be equal to atmospheric pressure, meaning that e.g. 50% of atmospheric pressure corresponds to a pressure of 500 mbar. Herein, vacuum may interchangeably be indicated as % of atmospheric pressure or in mbar. Reducing the pressure below that of atmospheric pressure implies that solvents, boils at a lower temperature. E.g. water present in the wooden material will be more easily evaporated ("boiled off" or withdrawn) with vacuum.

In one embodiment, the method of the present invention is such, wherein the vacuum is between 1% and 100% of atmospheric pressure, such as e.g. 80% (approximately 800 mbar) or 50% (approximately 500 mbar) of atmospheric pressure.

The vacuum should be chosen so as to obtain the desired evaporation of the water contained in the wooden material. The temperature during the vacuum step may thus be controlled having a view to the e.g. size, weight, density, shape and air and moisture content of the wooden material. The temperature during the vacuum step may therefore suitably be chosen so as to be from 1° C. to 100° C., such as from 20° C. to 70° C. or at room temperature.

In general, the vacuum is maintained for a period of time varying from 1 minute to 2 hours, such as 5 minutes, 10 minutes, 15 minutes, 20 minutes, 30 minutes, 40 minutes, 45 minutes, 50 minutes, 1 hour, 1 hour and 10 minutes, 1 hour and 20 minutes, 1 hour and 30 minutes, 1 hour and 40 minutes, 1 hour and 50 minutes or 2 hours. In one embodiment, the vacuum is maintained from 5 minutes to 2 hours, or from 15 minutes to 45 minutes. In another embodiment, the vacuum is maintained for 30 minutes. The period of time may thus be controlled having a view to the e.g. size, weight, density, shape and water content of the wooden material.

Subsequently, after maintaining the vacuum for a certain period of time, liquid is supplied with the vacuum pressure in the tank containing the wooden material, from the other tank containing the liquid. The amount of liquid needed may depend on the amount of wooden material present, the size, weight, density, shape and air and moisture content and type of each piece or log of wooden material, and further on the size and shape of the tanks used. In general, the liquid must be supplied in an amount to ensure that the wooden material is fully covered by the liquid and the tank with wood is filled with liquid.

The temperature during and following addition of liquid is chosen so as to be suited for supplying the liquid while keeping the liquid below its boiling point the used pressure. Typical temperatures may e.g. be from 20° C. to 70° C. In one embodiment, the temperature during the vacuum step is 70° C., and liquid having a temperature of 70° C. is supplied to the wooden material.

The temperature and the vacuum are kept for a suitable period of time, in one embodiment varying from minutes to hours, such as 5 minutes to 5 hours, such as 20 minutes, 45 minutes, 2 or 3 hours. Examples of suitable temperatures and vacuum are specified above.

Thereafter, the wooden material is subjected to an overpressure. This may take place either after equilibration of the vacuum to atmospheric pressure, or as a continuous process, where the pressure is raised from vacuum to the overpressure by means of a pressure pump as described above. The desired temperature during the overpressure phase is such which ensures that the liquid does not reach its boiling point. This temperature depends on the overpressure applied and on the liquid supplied. The temperature and the overpressure is kept for a suitable period of time, usually varying from 1 minute to 15 hours, such as 1 minute, 5 minutes, 15 minutes, 30 minutes, 45 minutes, 1 hour, 2 hours, 3, hours, 4 hours, 5 hours, 6 hours, 7 hours, 8 hours, 9 hours, 10 hours, 11 hours, 12 hours, 13 hours, 14 hours or 15 hours as well as any integer or non-integer therebetween. Usually, the temperature is from 70° C. to 220° C. In some embodiments, the temperature may be 70° C., 80° C., 90° C., 100° C., 110° C., 120° C., 130° C., 140° C., 150° C., 160° C., 170° C., 180° C., 190° C., 200° C., 210° C., or 220° C. as well as any integer or non-integer therebetween.

The pressure during the pressurising step may suitably be from 1 bar to 30 bar. Accordingly, the increased pressure may be 1 bar, 2 bar, 3 bar, 4 bar, 5 bar, 6 bar, 7 bar, 8 bar, 9 bar, 10 bar, 11 bar, 12 bar, 13 bar, 14 bar, 15 bar, 16 bar, 17 bar, 18 bar, 19 bar, 20 bar, 21 bar, 22 bar, 23 bar, 24 bar, 25 bar, 26 bar, 27 bar, 28 bar, 29 bar, or 30 bar as well as any non-integer therebetween. In one embodiment, the pressure may be from 5 bar to 30 bar. In another embodiment, the pressure is from 10 bar to 25 bar. In a certain embodiment, the pressure is 20 bar.

The wooden material is then subjected to ultrasound as specified herein. During treatment with ultrasound the pressure is maintained. The temperature during the ultrasound treatment may suitably be from 70° C. to 220° C. In some embodiments, the temperature may be 70° C., 80° C., 90° C., 100° C., 110° C., 120° C., 130° C., 140° C., 150° C., 160° C., 170° C., 180° C., 190° C., 200° C., 210° C., or 220° C. as well as any integer or non-integer therebetween. In a particular embodiment, the temperature is between 170° C. and 220° C. In one embodiment, ultrasound is applied for 2 hours or 2.5 hours at 12 bar or 20 bar.

The temperature during the various steps of the method according to the invention may suitably be controlled. Thereby, the impregnation of the wooden material may be efficiently controlled. In particular, the impregnation depth depends on the temperature, vacuum, pressure, ultrasound and time conditions and further on the properties and type of the wooden material. For some applications, wooden materials fully impregnated may be desired, whereas wooden materials only impregnated to a certain depth may be sufficient for other applications.

It has been shown and recognised that application of ultrasound at certain temperatures leads to a more evenly distributed impregnation of the wooden material. Furthermore, in general a somewhat lower temperature as compared to conventionally used methods can be maintained since the application of ultrasound facilitates the impregnation of the wooden material. Furthermore, the heating in combination with the ultrasound treatment enables that the colouring of the wooden material can be better controlled. In general, the higher the temperature, the darker the colouring of the wooden material. Furthermore, by choosing the components of the liquid, the colouring of the ores of the wooden material can be enhanced, thus, enabling the preparation of impregnated wooden material more appealing e.g. for decorative purposes.

The invention further relates to wooden material obtainable by the method as described herein. Such wooden material has a number of applications as indicated above.

In FIG. 1, the method of the invention is illustrated. FIG. 1 is intended as an illustration of a certain embodiment of the invention and should in no way be limiting on the scope of the invention. As can be seen from the figure, the method of the invention involves subjecting the wooden material to a vacuum between 0 mbar and atmospheric pressure (1000 mbar) at room temperature. The vacuum is kept for a certain period of time (exemplified by 45 minutes). Subsequently, liquid is supplied while maintaining the vacuum. The liquid is supplied during a certain period of time (exemplified by 10 minutes). Thereafter, the temperature and the pressure are increased. Prior to that, the pressure and the temperature may be equilibrated to ambient temperature and ambient pressure (atmospheric pressure) (not shown). The overpressure is illustrated by 15 bar, and the increased temperature is illustrated by 190° C. During the period with overpressure and increased temperature (both illustrated by a period of time of 120 minutes), the wooden material is subjected to ultrasound treatment. The ultrasound may be applied for shorter time than the period of time maintaining the overpressure and increased temperature (shown), or the ultrasound may be applied as long as the temperature and overpressure are maintained (not shown). The ultrasound may be applied continuously (shown) or as pulses of a certain length (not shown). Thereafter, the temperature and the overpressure may be equilibrated so as to reach ambient temperature (room temperature) and ambient pressure (atmospheric pressure). This may be accomplished by natural equilibration (shown) or by forced equilibration by ventilation or by a cooling aggregate.

Figure 2:
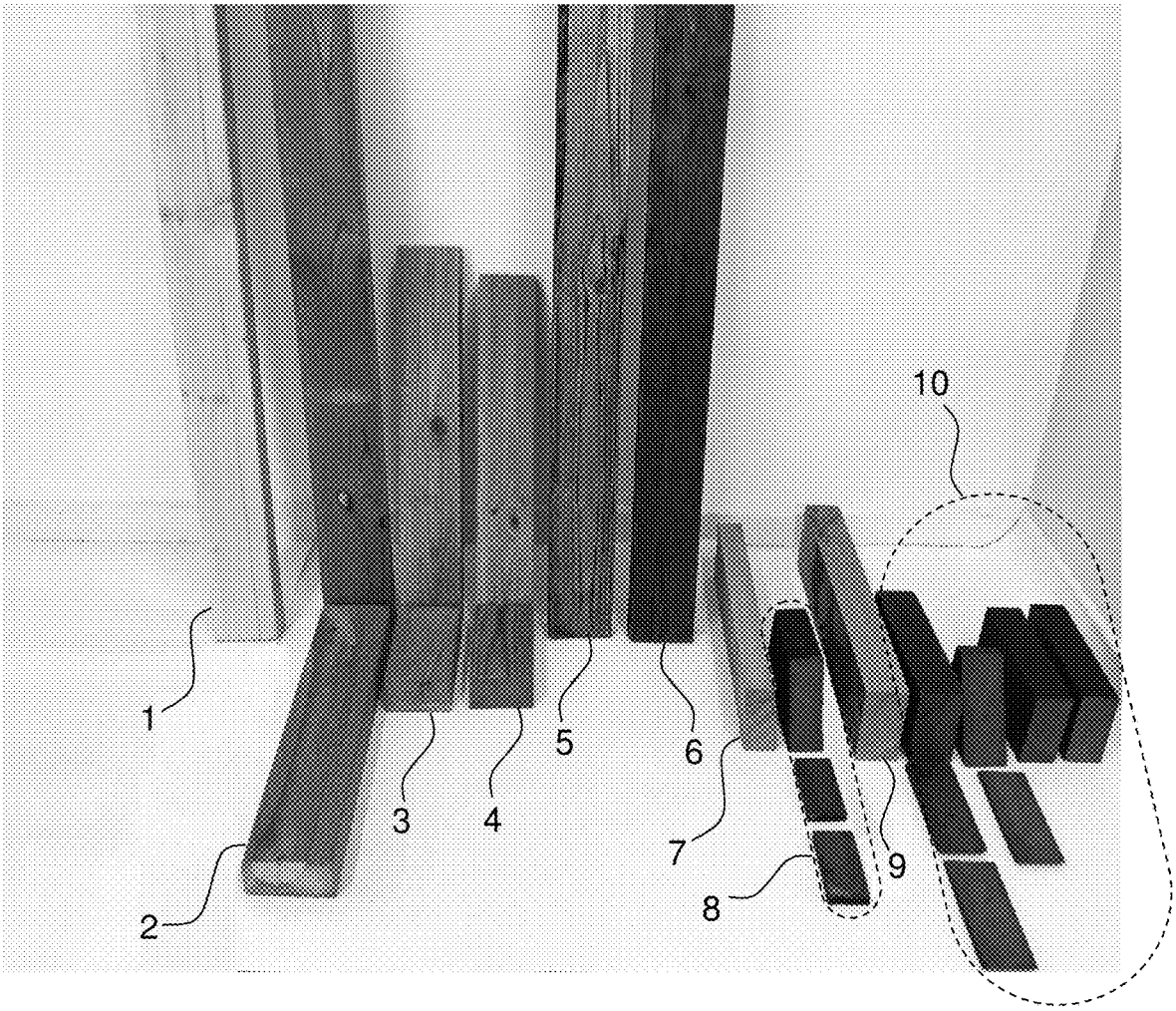
FIG. 2 shows, from left to right, untreated Nordic spruce (1), conventionally impregnated Nordic spruce (2), Nordic spruce treated with the method of the invention (3), Nordic spruce treated according to the method of the invention (4), Nordic spruce treated according to method of the invention (5), Nordic spruce treated according to the method of the invention (6), untreated Spanish *eucalyptus* (7), Spanish *eucalyptus* treated according to the method of the invention (8), untreated Danish oak (9), and Danish oak treated according to the method of the invention (10).
Figure 3:
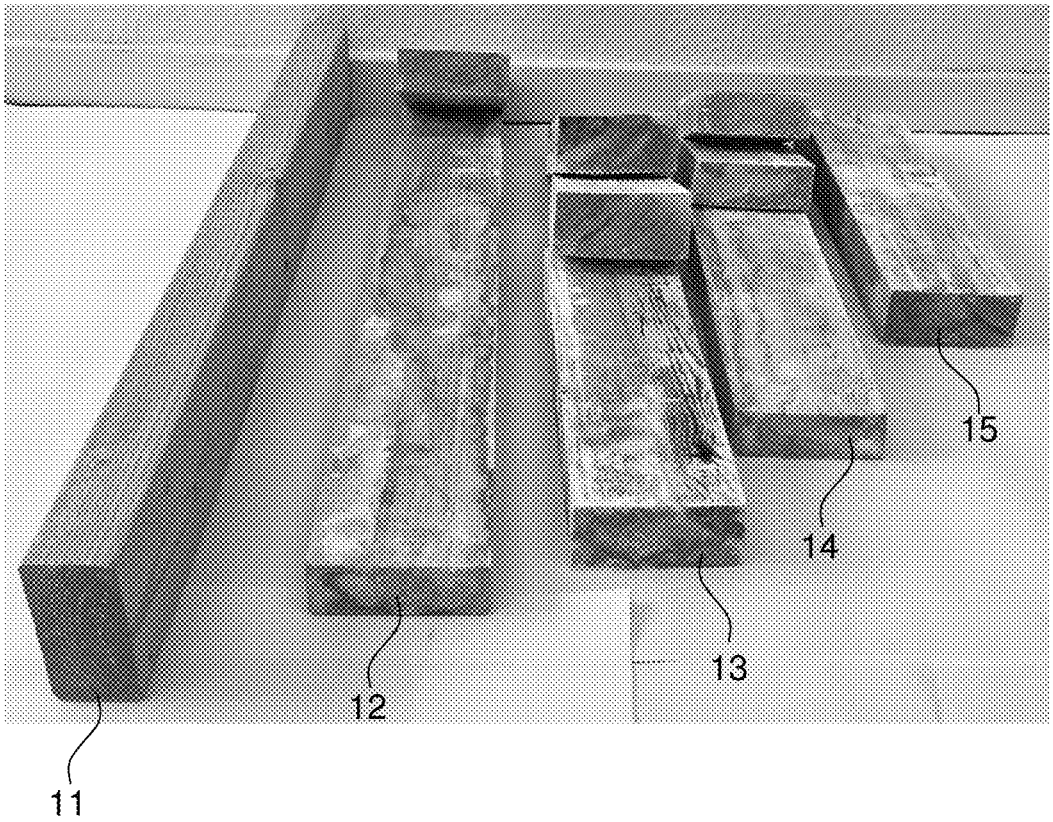
FIG. 3 shows, from left to right, Nordic spruce (11) treated with the method according to the invention, pine (12) treated with the method according to the invention, Nordic spruce (13) treated with the method according to the invention, Nordic spruce (14) treated with the method according to the invention, and Nordic spruce (15) treated with the method according to the invention.

In FIG. 2, untreated wooden material, conventional pressure-impregnated wooden material, and impregnated wooden material prepared according to the present invention are shown. In FIG. 3, wooden materials treated according to the invention are shown. The method of the present invention is further explained in the below, non-limiting example.

EXAMPLES

Example 1

Apparatus for Preforming the Method According to the Invention

Figure 4:
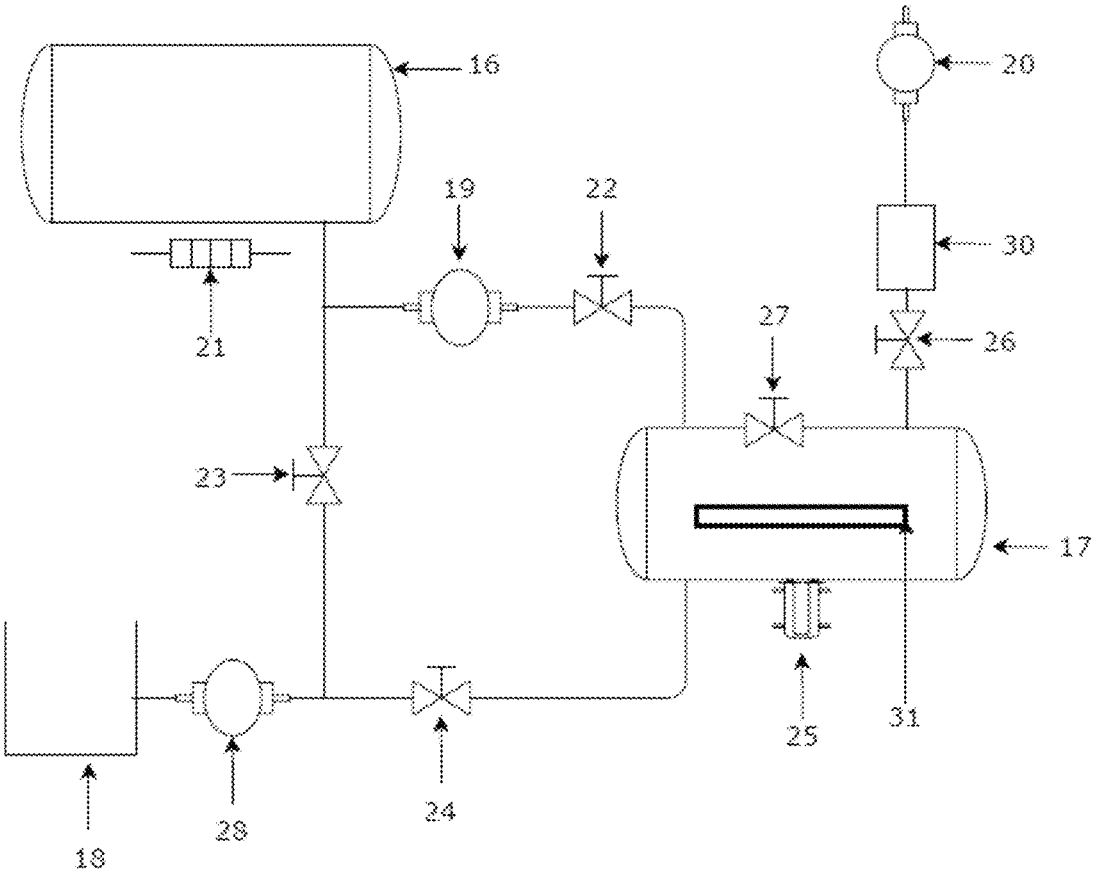
FIG. 4 shows a schematic representation of the apparatus for performing the method of the invention.

Reference is made to FIG. 4. FIG. 4 is a schematic representation of the apparatus used to perform the method of the invention. Logs of wooden material 31 having a suitable size were placed in an airtight tank 17 having a volume of approximately 1 $m^3$. The airtight 17 tank was chosen so as to be suited for both a pressurised and a depressurised environment. The airtight tank 17 was further equipped with a ultrasound generator (not shown). The airtight tank 17 was connected to a heating aggregate 25 for heating circulating liquid. Between the vacuum pump 20 and the valve 26, a protection tank 30 was present in order to protect the vacuum pump 20 against liquid. The airtight tank 17 was connected to a vacuum pump 20 and a valve 26. The airtight tank was further equipped with a valve 27 for safety reasons. A tank 18 containing the liquid was connected to a tank 16, the circuit having valves 23, 24 as well as a pressure pump 28. The tank 16 was further connected to a pressure pump 19 and valve 22. The tank 1 was equipped with a heating/cooling aggregate 21. Tank 18 was for storing the liquid until use only. To initiate the method of the invention the liquid was pumped into tank 16, and the connection between tank 18 and tank 16 were closed.

Figure 5:
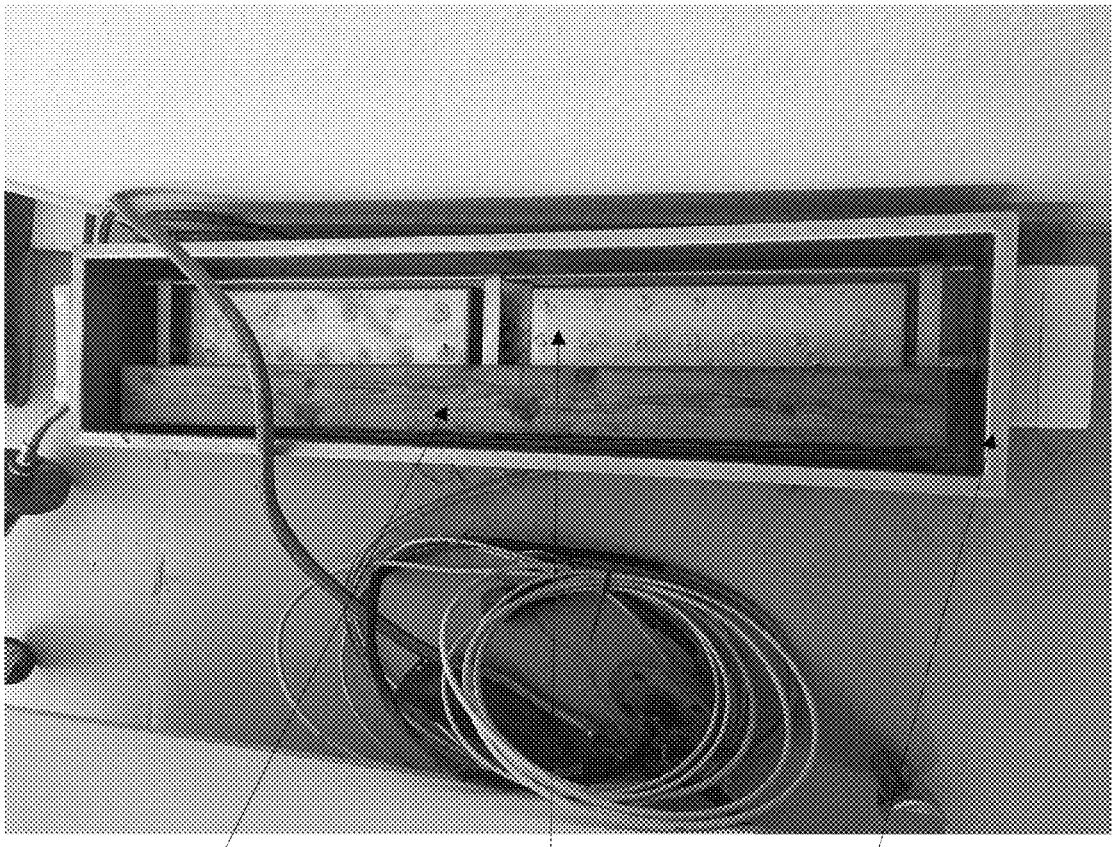
FIG. 5 shows a close-up of the airtight tank with a log of wooden material and the ultrasound generator.

In FIG. 5, part of the apparatus for performing the method of the invention is shown. FIG. 5 shows the airtight tank 17, the ultrasound generator 29 and a log of wooden material 31.

Example 2

Treatment of Wooden Material According to the Invention

The logs of wooden materials 31 were placed in the airtight tank 17 described in Example 1 and the method of the invention was performed in the following manner:

Step a)—Vacuum

The airtight tank 17 with the wooden material 31 (one log of wooden material) was depressurised to 50% of atmospheric pressure (500 mbar) using a vacuum pump 20 connected to the valve 26 at the top of the airtight tank 17. The Vacuum at 500 mbar was kept for 30 minutes. Thereby, air contained in the wooden material was removed from the wooden material.

Step b)—Addition of Liquid

The liquid (1000 litre) to be supplied to the wooden material was preheated in the tank 16 to a temperature of 70° C. The preheated liquid was supplied to the airtight tank 17 using the valve 23. As the pressure is 50% of atmospheric pressure (500 mbar) in the airtight tank 17, the liquid was readily sucked into the airtight tank 17 via the vacuum. The vacuum was maintained during the addition of the liquid by means of the vacuum pump 20, until the airtight tank 17 became filled with the liquid, and the wooden material was covered by the liquid. Thereafter, the vacuum pump 20 was turned off. Filling of the airtight tank 17 was verified by the presence of liquid in the tank 30.

Step c)—Overpressure and Heating

The pressure pump 19 was set to a pressure of 20 bar and started. The liquid of the airtight tank 17 was kept at the desired temperature between 70° C. and 220° C. (cf. Table 2 below for specific temperature) by circulating the liquid over a heating aggregate 25 by means of the pressure pump 19. Thus, the liquid (cf. Table 2 for specific liquid) was recirculated to maintain the desired temperature.

Step d)—Treatment with Ultrasound

When the pressure of 20 bar and the desired temperature were reached, ultrasound having a frequency of 30 kHz was applied for 2 or 3 hours (cf. Table 2 for specific time). The pressure was maintained at 20 bar during the ultrasound treatment. The temperature was kept at the desired temperature during the ultrasound treatment. Following ultrasound treatment, the pressure of 20 bar was maintained until the temperature in the airtight tank 17 (and the liquid and wooden material 28) was below 100° C. so as to avoid the boiling of the liquid, if water-based. In the case of the liquid being an oil or oil-mixture, a temperature below 100° C. was desired for safety reasons. When the desired temperature was reached, the pressure was equalised to atmospheric pressure by means of the valve 26, the liquid was withdrawn, and the wooden material 28 removed from the airtight tank 17.

It was demonstrated that by the combined use of heating and ultrasound, liquid was effectively drawn into the wooden material.

TABLE 1

| Wooden material. | | | |
|---|---|---|---|
| Sample number | Size of wooden material(cm × cm × cm) | Initial moisture content (%) | Wooden material |
| 1 | 120 × 9 × 4.5 | 17 | Nordic spruce |
| 2 | 120 × 9 × 45 | 17 | Nordic spruce |
| 3 | 120 × 9 × 4.5 | 17 | Nordic spruce |
| 4 | 120 × 9 × 4.5 | 17 | Nordic spruce |
| 5 | 120 × 9 × 4.5 | 17 | Nordic spruce |
| 6 | 120 × 9 × 4.5 | 17 | Nordic spruce |
| 7 | 35 × 9 × 4 | 17 | Spanish *eucalyptus* |

TABLE 1-continued

| Wooden material. | | | |
|---|---|---|---|
| Sample number | Size of wooden material(cm × cm × cm) | Initial moisture content (%) | Wooden material |
| 8 | 35 × 9 × 4 | 17 | Spanish *eucalyptus* |
| 9 | 40 × 10 × 5 | 7 | Danish oak |
| 10 | 40 × 10 × 5 | 7 | Danish oak |
| 11 | 120 × 9 × 4.5 | 17 | Nordic spruce |
| 12 | 120 × 9 × 4.5 | 17 | Pine |
| 13 | 120 × 9 × 4.5 | 17 | Nordic spruce |
| 14 | 120 × 9 × 4.5 | 17 | Nordic spruce |
| 15 | 120 × 9 × 4.5 | 17 | Nordic spruce |
| 16 | 120 × 9 × 4.5 | 17 | Pine |
| 17 | 120 × 9 × 4.5 | 17 | Nordic spruce |
| 18 | 120 × 9 × 4.5 | 17 | Danish oak |
| 19 | 120 × 9 × 4.5 | 17 | Meranti mahogany |
| 20 | 120 × 9 × 4.5 | 17 | Nordic spruce |
| 21 | 120 × 9 × 4.5 | 17 | Danish oak |
| 22 | 120 × 9 × 4.5 | 17 | Meranti mahogany |
| 23 | 120 × 9 × 4.5 | 17 | Nordic spruce |
| 24 | 120 × 9 × 4.5 | 17 | Danish oak |
| 25 | 120 × 9 × 4.5 | 17 | Meranti mahogany |
| 26 | 120 × 9 × 4.5 | 17 | Pine |
| 27 | 120 × 9 × 4.5 | 17 | Danish oak |
| 28 | 120 × 9 × 4.5 | 17 | Meranti mahogany |
| 29 | 120 × 9 × 4.5 | 17 | Pine |
| 30 | 120 × 9 × 4.5 | 17 | Danish oak |
| 31 | 120 × 9 × 4.5 | 17 | Meranti mahogany |
| 32 | 120 × 9 × 4.5 | 17 | Pine |
| 33 | 120 × 9 × 4.5 | 17 | Nordic spruce |
| 34 | 120 × 9 × 4.5 | 17 | Danish oak |
| 35 | 120 × 9 × 4.5 | 17 | Meranti mahogany |
| 36 | 120 × 9 × 4.5 | 17 | Pine |
| 37 | 120 × 9 × 4.5 | 17 | Nordic spruce |
| 38 | 120 × 9 × 4.5 | 17 | Danish oak |
| 39 | 120 × 9 × 4.5 | 17 | Meranti mahogany |
| 40 | 120 × 9 × 4.5 | 17 | Pine |
| 41 | 120 × 9 × 4.5 | 17 | Nordic spruce |
| 42 | 120 × 9 × 4.5 | 17 | Danish oak |
| 43 | 120 × 9 × 4.5 | 17 | Meranti mahogany |

In Table 1, the sample numbers 1 to 15 refer to the logs shown in FIG. 2 and FIG. 3, respectively.

Sample number 1 is untreated Nordic spruce.

Sample number 2 is conventionally impregnated (copper-impregnated)
Nordic spruce.

Sample number 3 is Nordic spruce treated according to the method according of the invention.

Sample number 4 is Nordic spruce treated according to the method of the invention.

Sample number 5 is Nordic spruce treated according to the method of the invention.

Sample number 6 is Nordic spruce treated according to the method of the invention.

Sample number 7 is untreated *Eucalyptus*.

Sample number 8 is *Eucalyptus* treated according to the method of the invention and cut after treatment.

Sample number 9 is untreated Danish oak.

Sample number 10 is Danish oak treated according to the method of the invention and cut after treatment.

Sample number 11 is Nordic spruce treated according to the method of the invention.

Sample number 12 is pine treated according to the method of the invention.

Sample number 13 is Nordic spruce treated according to the method of the invention.

Sample number 14 is Nordic spruce treated according to the method of the invention.

Sample number 15 is Nordic spruce treated according to the method of the invention.

TABLE 2

| Treatment of wooden material. | | | |
|---|---|---|---|
| Sample number | Liquid | Temperature Step c) | Temperature/time ultrasound Step d) |
| 3 | Demineralised water (calcium-free) | 170° C. | 170° C./2 hours |
| 4 | Demineralised water (calcium-free) | 180° C. | 180° C./2 hours |
| 5 | 1:1 Linseed oil:wood tar | 190° C. | 190° C./2 hours |
| 6 | 1:1 Linseed oil:wood tar | 200° C. | 200° C./2 hours |
| 8 | 1:1 Linseed oil:wood tar | 200° C. | 200° C./2 hours |
| 10 | 1:1 Linseed oil:wood tar | 220° C. | 220° C./2 hours |

TABLE 2-continued

Treatment of wooden material.

| Sample number | Liquid | Temperature Step c) | Temperature/time ultrasound Step d) |
|---|---|---|---|
| 11 | Alum 5% in demineralised water (calcium free) | 70° C. | 70° C./3 hours |
| 12 | Alum 10% in demineralised water (calcium-free) | 70° C. | 70° C./3 hours |
| 13 | Alum 20% in demineralised water (calcium-free) | 70° C. | 70° C./3 hours |
| 14 | Alum 20% in demineralised water (calcium-free) | 70° C. | 70° C./3 hours |
| 15 | Boron 20% in demineralised water (calcium-free) | 70° C. | 70 C./3 hours |
| 16 | Water (calcium-free) with colour pigment (579 kg/m$^3$) | 70° C. | 70° C./3 hours |
| 17 | Water (calcium-free) with colour pigment (478 kg/m$^3$) | 70° C. | 70° C./3 hours |
| 18 | Water (calcium-free) with colour pigment | 70° C. | 70° C./3 hours |
| 19 | Water (calcium-free) with colour pigment (307 kg/m$^3$) | 70° C. | 70° C./3 hours |
| 20 | Alum 5% in demineralised water (calcium-free) | 70° C. | 70° C./3 hours |
| 21 | Alum 5% in demineralised water (calcium-free) | 70° C. | 70° C./3 hours |
| 22 | Alum 5% in demineralised water (calcium-free) | 70° C. | 70° C./3 hours |
| 23 | Alum 10% in demineralised water (calcium-free) | 70° C. | 70° C./3 hours |
| 24 | Alum 10% in demineralised water (calcium-free) | 70° | 70°/3 hours |
| 25 | Alum 10% in demineralised water (calcium-free) | 70° C. | 70° C./3 hours |
| 26 | Alum 20% in demineralised water (calcium-free) | 70° C. | 70° C./3 hours |
| 27 | Alum 20% in demineralised water (calcium-free) | 70° C. | 70° C./3 hours |
| 28 | Alum 20% in demineralised water (calcium-free) | 70 C. ° | 70° C./3 hours |
| 29 | Boron 20% in demineralised water (calcium-free) | 70° C. | 70° C./3 hours |
| 30 | Boron 20% in demineralised water (calcium-free) | 70° C. | 70° C./3 hours |
| 31 | Boron 20% in demineralised water (calcium-free) | 70° C. | 70° C./3 hours |
| 32 | 1:1 Linseed oil/wood tar | 170° C. | 170° C./2 hours |
| 33 | 1:1 Linseed oil/wood tar | 170° C. | 170° C./2 hours |
| 34 | 1:1 Linseed oil/wood tar | 170° C. | 170° C./2 hours |
| 35 | 1:1 Linseed oil/wood tar | 170° C. | 170° C./2 hours |
| 36 | Wood tar | 220° C. | 220° C./2 hours |
| 37 | Wood tar | 220° C. | 220° C./2 hours |
| 38 | Wood tar | 220° C. | 220° C./2 hours |
| 39 | Wood tar | 220° C. | 220° C./2 hours |
| 40 | Copper (Celcure AC800) | 70° C. | 70° C./3 hours |
| 41 | Copper (Celcure AC800) | 70° C. | 70° C./3 hours |
| 42 | Copper (Celcure AC800) | 70° C. | 70° C./3 hours |
| 43 | Copper (Celcure AC800) | 70° C. | 70° C./3 hours |

As can be seen from FIG. 2, the conventionally impregnated Nordic spruce is only impregnated at surface. The impregnation is further uneven, and the impregnation depth is at maximum approximately 0.5 cm. Thus, the log is mostly left unimpregnated. Furthermore, the use of copper-based impregnating agents is undesired since these compounds are environmentally harmful and also harmful to human beings.

As can be seen from FIG. 2, the logs of wooden material were fully impregnated using the method according to the invention. No part of the wooden material was left untreated. Furthermore, the ores of the wooden material were enhanced, if colouring agents (e.g. a combination of linseed oil and wood tar (liquid)) were used in combination with temperature of the liquid at which the sugar constituents of the wooden material were not fully "burned-off". Thereby, the impregnated wooden material appeared more natural and appealing. A darker colouring of the wooden material was obtained using a higher temperature during treatment with overpressure and ultrasound, due to the "burning off" of the sugar constituents. Furthermore, as can be seen, all types of wooden material (from softer to harder wooden material) were fully impregnated using only environmentally safe agents (linseed oil and wood tar are not considered environmentally harmful).

It appears from FIG. 3, that logs of both pine and Nordic spruce were fully impregnated using salts. Alum and boron are considered environmentally safe. As the logs were fully impregnated, the flame retarding effect can be considered increased. Furthermore, even using a 5% solution of flame retardant, the wooden material became fully impregnated. At higher concentrations, some precipitation of the salts was observed. This was believed to be due to drying of the wooden material. The precipitation is merely an aesthetic effect.

Sample numbers 16 to 43 were all also fully impregnated. No areas throughout the wooden material were left untreated, independent of the species of wooden material, the applied liquid (e.g. water, wood tar, flame retardants, and oils), and the temperature during step c) and d).

In conclusion, wooden materials derived from several tree species were fully impregnated using the method of the invention. Furthermore, the wooden materials became fully impregnated using the method of the invention, i.e. no untreated/unimpregnated sites were observed. Thereby, the method of the present invention was clearly superior to conventionally used methods. Furthermore, environmentally safe materials can be added to the liquid, and those additives penetrated fully into the wooden material, both in the case of softer and harder sorts of wooden materials. This was an improvement, when compared to conventionally used impregnation methods.

LIST OF REFERENCE NUMERALS

1 Wooden material
2 Wooden material
3 Wooden material
4 Wooden material
5 Wooden material
6 Wooden material
7 Wooden material
8 Wooden material
9 Wooden material
10 Wooden material
11 Wooden material
12 Wooden material
13 Wooden material
14 Wooden material
15 Wooden material
16 Tank
17 Tank
18 Tank
19 Pressure pump
20 Vacuum pump
21 Heating/cooling aggregate
22 Valve
23 Valve
24 Valve
25 Heating/cooling aggregate
26 Valve
27 Valve
28 Pressure pump
29 Ultrasound generator
30 Tank
31 Wooden material

The invention claimed is:

1. A method for the treatment of a wooden material, the method comprising the steps of:

a) subjecting the wooden material to a vacuum, b) supplying a liquid to the wooden material, while maintaining the vacuum, c) subjecting the wooden material to an overpressure at a temperature between 70° C. and 220° C. at which the liquid does not reach its boiling point, d) subjecting the wooden material to ultrasound, while maintaining the over pressure, at a temperature between 70° C. and 220° C.

2. The method according to claim 1, wherein the ultrasound has a frequency of from 1 kHz to 120 kHz.

3. The method according to claim 1, wherein the ultrasound has a frequency of 30 kHz or less.

4. The method according to claim 1, wherein the ultrasound is applied for 5 minutes to 12 hours.

5. The method according to claim 1, wherein the temperature in steps a) to d) is controlled.

6. The method according to claim 1, wherein the vacuum is 80% of atmospheric pressure or less.

7. The method according to claim 1, wherein the vacuum is maintained from 15 minutes to 45 minutes.

8. The method according to claim 1, wherein the overpressure is from 10 bar to 40 bar.

9. The method according to claim 1, wherein the liquid is at least one of water, oils, pigments and colourants, alum 5% v/v, alum 10% v/v, alum 20% v/v, boric acid solutions, flame retardants, biocides, fungicides, or copper.

10. The method according to claim 1, wherein the liquid is water, aqueous solvent or oil.

11. The method according to claim 1, wherein the steps of the method take place in an airtight tank.

12. A wooden material obtained by the method of claim 1.

* * * * *